US011214847B2

(12) United States Patent
Nakata et al.

(10) Patent No.: US 11,214,847 B2
(45) Date of Patent: Jan. 4, 2022

(54) HIGH-STRENGTH HOT-ROLLED STEEL SHEET FOR ELECTRIC RESISTANCE WELDED STEEL PIPE AND MANUFACTURING METHOD THEREFOR

(71) Applicant: JFE Steel Corporation, Tokyo (JP)

(72) Inventors: Hiroshi Nakata, Tokyo (JP); Motohiko Urabe, Tokyo (JP); Shuji Kawamura, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 376 days.

(21) Appl. No.: 16/071,557

(22) PCT Filed: Jan. 23, 2017

(86) PCT No.: PCT/JP2017/002041
§ 371 (c)(1),
(2) Date: Jul. 20, 2018

(87) PCT Pub. No.: WO2017/130875
PCT Pub. Date: Aug. 3, 2017

(65) Prior Publication Data

US 2019/0062862 A1 Feb. 28, 2019

(30) Foreign Application Priority Data

Jan. 27, 2016 (JP) ..... JP2016-012891

(51) Int. Cl.
*C21D 9/46* (2006.01)
*C22C 38/58* (2006.01)
(Continued)

(52) U.S. Cl.
CPC ..... *C21D 9/46* (2013.01); *C21D 8/0205* (2013.01); *C21D 8/0226* (2013.01);
(Continued)

(58) Field of Classification Search
CPC ..... C21D 9/46; C21D 8/0205; C21D 8/0226; C21D 8/0263; C21D 2211/001;
(Continued)

(56) References Cited

U.S. PATENT DOCUMENTS

2014/0242416 A1* 8/2014 Matsuda ..... C22C 38/08 428/659
2014/0290807 A1* 10/2014 Goto ..... C22C 38/06 148/506
(Continued)

FOREIGN PATENT DOCUMENTS

EP 2 735 622 A1 5/2014
EP 3 112 488 A1 1/2017
(Continued)

OTHER PUBLICATIONS

WO-2014148001-A1 english translation (Year: 2014).*
(Continued)

*Primary Examiner* — Anthony J Zimmer
*Assistant Examiner* — Ricardo D Morales
(74) *Attorney, Agent, or Firm* — DLA Piper LLP (US)

(57) ABSTRACT

A high-strength hot-rolled steel sheet for an electric resistance welded steel pipe has decreased variations in in-plane material properties, high strength, and excellent ductility. The high-strength hot-rolled steel sheet has a composition containing, in mass %, C: 0.10 to 0.18%, Si: 0.1 to 0.5%, Mn: 0.8 to 2.0%, P: 0.001 to 0.020%, S: 0.005% or less, Al: 0.001 to 0.1%, Cr: 0.4 to 1.0%, Cu: 0.1 to 0.5%, Ni: 0.01 to 0.4%, Nb: 0.01 to 0.07%, N: 0.008% or less, and further Mo: 0.5% or less and/or V: 0.1% or less so that Moeq defined as Moeq=Mo+0.36Cr+0.77Mn+0.07Ni is 1.4 to 2.2, and Mo and V are contained to satisfy 0.05≤Mo+V≤0.5; and has a microstructure containing, in volume fraction, 80% or more of a bainite phase as a primary phase and 4 to 20% of a
(Continued)

martensite phase and a retained austenite phase in total as a secondary phase, where the bainite phase has an average grain size of 1 to 10 μm.

10 Claims, 1 Drawing Sheet

(51) Int. Cl.

| | |
|---|---|
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |

(52) U.S. Cl.
CPC ..... *C21D 8/0263* (2013.01); *C22C 38/00* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C22C 38/58* (2013.01); *C21D 2211/001* (2013.01); *C21D 2211/002* (2013.01); *C21D 2211/008* (2013.01)

(58) Field of Classification Search
CPC ..... C21D 2211/002; C21D 2211/008; C22C 38/00; C22C 38/001; C22C 38/002; C22C 38/005; C22C 38/02; C22C 38/04; C22C 38/06; C22C 38/42; C22C 38/44; C22C 38/46; C22C 38/48; C22C 38/50; C22C 38/54; C22C 38/58
See application file for complete search history.

(56) References Cited

U.S. PATENT DOCUMENTS

| | | | |
|---|---|---|---|
| 2015/0004050 | A1 | 1/2015 | Matsuki et al. |
| 2015/0232970 | A1 | 8/2015 | Kami et al. |

FOREIGN PATENT DOCUMENTS

| | | | | |
|---|---|---|---|---|
| JP | 8-3641 | A | 1/1996 | |
| JP | 8-144019 | A | 6/1996 | |
| JP | 11-50188 | A | 2/1999 | |
| JP | 11-343542 | A | 12/1999 | |
| JP | 2001-131698 | A | 5/2001 | |
| JP | 2009-270142 | A | 11/2009 | |
| WO | 99/05335 | A1 | 2/1999 | |
| WO | 2013/108861 | A1 | 7/2013 | |
| WO | 2014/041802 | A1 | 3/2014 | |
| WO | WO-2014148001 | A1 * | 9/2014 | ..... C22C 38/002 |
| WO | 2015/129199 | A1 | 9/2015 | |

OTHER PUBLICATIONS

Bhadeshia et al. ("Bainite in steels." Metallurgical transactions A 21.3 (1990): 189-200) (Year: 1990).*

Extended European Search Report dated Sep. 21, 2018, of counterpart European Application No. 17744105.2.

Office Action dated Feb. 12, 2020, of counterpart Korean Application No. 10-2018-7020980, along with a Concise Statement of Relevance of Office Action in English.

Office Action dated Jul. 16, 2019, of counterpart Canadian Application No. 3,007,073.

Office Action dated Jul. 26, 2019, of counterpart Chinese Application No. 201780007932.0, along with a Concise Statement of Relevance of Office Action in English.

Office Action dated Oct. 18, 2020, of counterpart Korean Application No. 10-2018-7020980, along with a Concise Statement of Relevance of Office Action in English.

* cited by examiner

HIGH-STRENGTH HOT-ROLLED STEEL SHEET FOR ELECTRIC RESISTANCE WELDED STEEL PIPE AND MANUFACTURING METHOD THEREFOR

TECHNICAL FIELD

This disclosure relates to a high-strength hot-rolled steel sheet for an electric resistance welded steel pipe and a manufacturing method therefor. More particularly, the disclosure relates to a high-strength hot-rolled steel sheet for an electric resistance welded steel pipe suitable for coil tubing, which is a long electric resistance welded steel pipe, and has excellent formability, and to a manufacturing method therefor, in addition to a high-strength hot-rolled steel sheet for an electric resistance welded steel pipe having excellent uniformity of material properties and decreased variations in material properties, and to a manufacturing method therefor.

BACKGROUND

Fossil fuels such as natural gas and petroleum exist primarily in voids of or beneath impermeable layers in the earth. Wells need to be drilled to extract such fossil fuels. In recent years, however, fossil fuels exist in deeper layers, and such fossil fuels are present in a small scale. Accordingly, there is a need to drill many deep wells. In this circumstance, high-strength steel pipes that can be used as long pipes are required to repeatedly move drilling tools into and from deep wells. To prepare a long steel pipe, a method of joining steel pipes with lengths of about 10 to 20 m by using screws, for example, and deploying the resulting steel pipe into a well is conventionally employed.

For the above-mentioned application, however, coil tubing, which is a continuous steel pipe coiled on a spool, is currently used. By using such coil tubing, the efficiency of deploying drilling tools into wells is known to be more dramatically enhanced than ever before. Accordingly, there is a need for a high-strength hot-rolled steel sheet suitable for coil tubing.

In response to such a need, Japanese Unexamined Patent Application Publication No. 8-3641, for example, describes a manufacturing method for a high tensile strength electric resistance welded steel pipe. In the technique described in Japanese Unexamined Patent Application Publication No. 8-3641, a high tensile strength electric resistance welded steel pipe is obtained by hot-rolling steel having a composition containing, in weight %, C: 0.09 to 0.18%, Si: 0.25 to 0.45%, Mn: 0.70 to 1.00%, Cu: 0.20 to 0.40%, Ni: 0.05 to 0.20%, Cr: 0.50 to 0.80%, Mo: 0.10 to 0.40%, and S: 0.0020% or less at a finish rolling temperature of $Ar_3$ to 950° C., followed by coiling at 400° C. to 600° C., making a pipe from the resulting strip steel by electric resistance welding, and subsequently heat-treating at higher than 750° C. and lower than 950° C. The technique described in Japanese Unexamined Patent Application Publication No. 8-3641 features coiling immediately after heat treatment and during cooling and, consequently, a high tensile strength electric resistance welded steel pipe having excellent corrosion resistance and ductility can be obtained.

In addition, Japanese Unexamined Patent Application Publication No. 8-144019 describes a manufacturing method for bainitic steel, the method including heating steel having a composition containing, in weight %, C: 0.001% or more and less than 0.030%, Si: 0.60% or less, Mn: 1.00 to 3.00%, Nb: 0.005 to 0.20%, B: 0.0003 to 0.0050%, and Al: 0.100% or less to a temperature of $Ac_3$ to 1350° C., then finishing rolling at 800° C. or higher in the austenite non-recrystallization temperature region, and subsequently performing precipitation treatment through further reheating to a temperature range of 500° C. or higher and lower than 800° C. and retaining the temperature. In the technique described in Japanese Unexamined Patent Application Publication No. 8-144019, a bainite single phase microstructure is formed at any cooling rate employed in industrial-scale manufacture and, consequently, a thick steel sheet having extremely small variations in material properties in the thickness direction can be obtained.

Further, Japanese Unexamined Patent Application Publication No. 11-343542 describes a manufacturing method for a steel pipe that has a metal microstructure containing, in area fraction, 2 to 15% of a martensite-austenite constituent and excellent buckling resistance characteristics, the method including heating steel having a composition containing, in weight %, C: 0.03 to 0.15%, Si: 0.01 to 1%, Mn: 0.5 to 2%, and further one or two or more selected from Cu: 0.05 to 0.5%, Ni: 0.05 to 0.5%, Cr: 0.05 to 0.5%, Mo: 0.05 to 0.5%, Nb: 0.005 to 0.1%, V: 0.005 to 0.1%, and Ti: 0.005 to 0.1% to 1,000° C. to 1,200° C., followed by hot rolling, cooling the hot-rolled steel sheet from a temperature region of $Ar_3$ to ($Ar_3$−80° C.) at an average steel sheet cooling rate of 5° C./s or faster, terminating the cooling in a temperature range of 500° C. or lower, and subsequently cold-forming. In the technique described in Japanese Unexamined Patent Application Publication No. 11-343542, buckling resistance characteristics are enhanced due to the mixed microstructure composed of a hard martensite-austenite constituent and a relatively soft ferrite or bainite microstructure.

Moreover, Japanese Unexamined Patent Application Publication No. 2001-131698 describes a steel pipe having a yield strength of 758 MPa or higher and excellent sulfide stress cracking resistance, containing, in mass %, C: 0.2 to 0.35%, Si: 0.05 to 0.5%, Mn: 0.1 to 1%, P: 0.025% or less, S: 0.01% or less, Cr: 0.1 to 1.2%, Mo: 0.1 to 1%, Al: 0.005 to 0.1%, B: 0.0001 to 0.01%, Nb: 0.005 to 0.5%, N: 0.005% or less, O: 0.01% or less, Ni: 0.1% or less, Ti: 0 to 0.03% and 0.00008/N % or lower, V: 0 to 0.5%, W: 0 to 1%, Zr: 0 to 0.1%, and Ca: 0 to 0.01%, where the number of TiN with a diameter of 5 μm or smaller is 10 or less per cross section of 1 $mm^2$. In the technique described in Japanese Unexamined Patent Application Publication No. 2001-131698, since the amount of precipitated TiN with a diameter of 5 μm or smaller greatly affects sulfide stress cracking resistance, manufacturing is performed by preparing a medium carbon composition, adjusting the amount of precipitated TiN, and quenching and tempering after making a pipe.

The technique described in Japanese Unexamined Patent Application Publication No. 8-3641, however, requires post heat treatment at a high temperature of 750° C. or higher to ensure high strength of a steel pipe since the strength of a material steel sheet is low. Accordingly, there is a problem in which energy efficiency deteriorates, and surface quality deteriorates due to oxidation during heat treatment.

In the technique described in Japanese Unexamined Patent Application Publication No. 8-144019, there is a problem in which achievable strength is limited since the C amount is kept low. Also, in the technique described in Japanese Unexamined Patent Application Publication No. 11-343542, there is a problem in which productivity significantly decreases because, after finishing hot rolling, time is required during cooling for the temperature to reach $Ar_3$ or lower at which ferrite transformation occurs. Further, in the technique described in Japanese Unexamined Patent Application Publication No. 2001-131698, which requires heating to a high temperature of 900° C. or higher for quenching, there is a problem in which energy efficiency deteriorates during manufacturing, surface quality deteriorates due to oxidation during heat treatment, and flow in piping, for example, is obstructed by peeled surface oxides during use.

It could therefore be helpful to provide a high-strength hot-rolled steel sheet suitable for coil tubing, which is a long electric resistance welded steel pipe and has decreased variations in in-plane mechanical characteristics (material properties), high strength, and excellent ductility, as well as a manufacturing method therefor. For coil tubing, the hot-rolled steel sheet preferably has a sheet thickness of 2 to 8 mm. The term "high strength" herein refers to a tensile strength TS of 900 MPa or higher. The phrase "excellent ductility" herein refers to an elongation El of 16% or higher. Further, the phrase "decreased variations in in-plane mechanical characteristics (material properties)" herein refers to variations in in-plane yield strength YS of 70 MPa or less.

Summary

We thus provide:

(1) A high-strength hot-rolled steel sheet for an electric resistance welded steel pipe, having a composition containing, in mass %, C: 0.10 to 0.18%, Si: 0.1 to 0.5%, Mn: 0.8 to 2.0%, P: 0.001 to 0.020%, S: 0.005% or less, Al: 0.001 to 0.1%, Cr: 0.4 to 1.0%, Cu: 0.1 to 0.5%, Ni: 0.01 to 0.4%, Nb: 0.01 to 0.07%, N: 0.008% or less, and further Mo: 0.5% or less and/or V: 0.1% or less so that Moeq, defined by equation (1) below, is 1.4 to 2.2, where Moeq is defined as:

$$Moeq=Mo+0.36Cr+0.77Mn+0.07Ni \quad (1)$$

where Mo, Cr, Mn, and Ni represent the contents of the respective elements (mass %), and an element, if not contained, is set to zero, and so that Mo and V are contained to satisfy expression (2) below:

$$0.05 \leq Mo+V \leq 0.5 \quad (2)$$

where Mo and V represent the contents of the respective elements (mass %), and an element, if not contained, is set to zero, and a balance of Fe and incidental impurities; and having a microstructure containing, in volume fraction, 80% or more of a bainite phase as a primary phase and 4 to 20% of a martensite phase and a retained austenite phase in total as a secondary phase, where the bainite phase has an average grain size of 1 to 10 μm.

(2) The high-strength hot-rolled steel sheet for an electric resistance welded steel pipe according to (1), where the composition further contains, in mass %, one or two or more selected from Ti: 0.03% or less, Zr: 0.04% or less, Ta: 0.05% or less, and B: 0.0010% or less.

(3) The high-strength hot-rolled steel sheet for an electric resistance welded steel pipe according to (1) or (2), where the composition further contains, in mass %, one or two selected from Ca: 0.005% or less and REM: 0.005% or less.

(4) A method of manufacturing a high-strength hot-rolled steel sheet for an electric resistance welded steel pipe, having a microstructure containing, in volume fraction, 80% or more of a bainite phase as a primary phase, and 4 to 20% of a martensite phase and a retained austenite phase in total as a secondary phase, where the bainite phase has an average grain size of 1 to 10 μm, the method including a heating step and a hot-rolling step of steel to yield a hot-rolled steel sheet, where: the steel has a composition containing, in mass %, C: 0.10 to 0.18%, Si: 0.1 to 0.5%, Mn: 0.8 to 2.0%, P: 0.001 to 0.020%, S: 0.005% or less, Al: 0.001 to 0.1%, Cr: 0.4 to 1.0%, Cu: 0.1 to 0.5%, Ni: 0.01 to 0.4%, Nb: 0.01 to 0.07%, N: 0.008% or less, and further Mo: 0.5% or less and/or V: 0.1% or less so that Moeq, defined by equation (1) below, is 1.4 to 2.2, where equation (1) is:

$$Moeq=Mo+0.36Cr+0.77Mn+0.07Ni \quad (1)$$

where Mo, Cr, Mn, and Ni represent the contents of the respective elements (mass %), and an element, if not contained, is set to zero, and so that Mo and V are contained to satisfy expression (2) below:

$$0.05 \leq Mo+V \leq 0.5 \quad (2)$$

where Mo and V represent the content of the respective elements (mass %), and an element, if not contained, is set to zero, and a balance of Fe and incidental impurities; the heating step is a process of heating the steel to a heating temperature of 1,150° C. to 1,270° C.; the hot-rolling step is a process including hot-rolling at a finish rolling temperature in a temperature range of 810° C. to 930° C. and at a cumulative reduction ratio in a temperature range of 930° C. or lower of 20 to 65%, then cooling to a cooling stop temperature in a temperature range of 420° C. to 600° C. at an average cooling rate of 10° C./s to 70° C./s, and coiling in a temperature range of 400° C. to 600° C., where in the hot rolling step, an in-plane temperature fluctuation in the finish rolling temperature is 50° C. or less, and an in-plane temperature fluctuation in the coiling temperature is 80° C. or less.

(5) The method of manufacturing a high-strength hot-rolled steel sheet for an electric resistance welded steel pipe according to (4), where the composition further contains, in mass %, one or two or more selected from Ti: 0.03% or less, Zr: 0.04% or less, Ta: 0.05% or less, and B: 0.0010% or less.

(6) The method of manufacturing a high-strength hot-rolled steel sheet for an electric resistance welded steel pipe according to (4) or (5), where the composition further contains, in mass %, one or two selected from Ca: 0.005% or less and REM: 0.005% or less.

A high-strength hot-rolled steel sheet for an electric resistance welded steel pipe having high tensile strength TS: 900 MPa or higher and excellent ductility of elongation El: 16% or higher can be manufactured in a stable manner with decreased variations in material properties, thereby exerting industrially remarkable effects. Also, the hot-rolled steel sheet has decreased variations in in-plane material properties and is thus suitable for the manufacture of a long steel pipe having stable characteristics as coil tubing, which is a long steel pipe used in oil wells and/or gas wells of great depth. As a further effect, it is expected that the life of a steel pipe can be extended dramatically.

DETAILED DESCRIPTION

Figure 1:
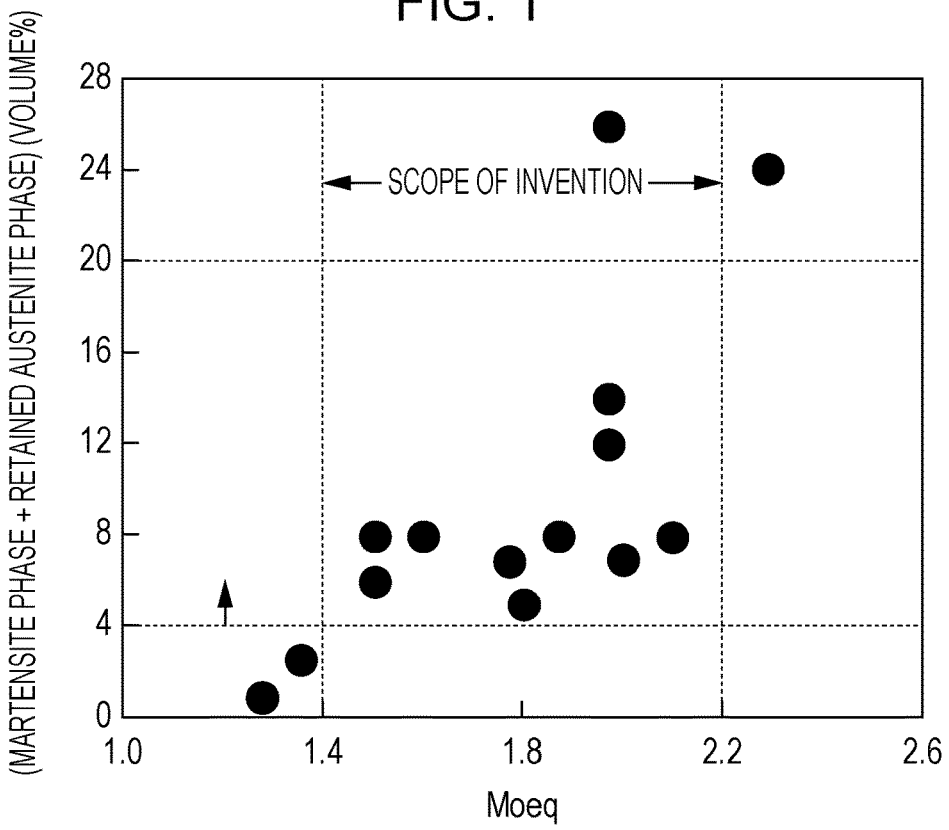
FIG. 1 is a graph showing the relationship between Moeq and microstructure fraction of the secondary phase.

First, the reasons for limiting the composition of a hot-rolled steel sheet will be described. Hereinafter, mass % is simply denoted by % unless otherwise indicated.

C: 0.10 to 0.18%

C is an element that contributes to increased strength of a steel sheet. The content of C needs to be 0.10% or more to realize a microstructure containing a bainite phase as a primary phase, and a martensite phase and a retained austenite phase as a secondary phase, as well as to increase the strength of a steel sheet. Meanwhile, when the content of C exceeds 0.18%, ductility decreases, thereby decreasing formability. Accordingly, the content of C is 0.10 to 0.18%.

Si: 0.1 to 0.5%

Si is an element that acts as a deoxidizer and contributes to increased strength through dissolution. The content of Si has to be 0.1% or more to provide such effects. Meanwhile, when the content of Si exceeds 0.5%, weldability in electric resistance welding decreases. Accordingly, the content of Si is 0.1 to 0.5%. The content of Si is preferably 0.2% or more and more preferably 0.3% or more.

Mn: 0.8 to 2.0%

Mn is an element that contributes to increased strength through enhanced hardenability and effectively contributes to formation of a microstructure containing a bainite phase as a primary phase. Such effects become remarkable by setting the content of Mn to 0.8% or more. Meanwhile, when Mn is contained in a large amount exceeding 2.0%, toughness of an electric resistance weld zone decreases. Accordingly, the content of Mn is 0.8 to 2.0%. The content of Mn is preferably 1.0 to 2.0% and more preferably 1.4 to 2.0%.

P: 0.001 to 0.020%

P is an element that increases the strength of a steel sheet and also contributes to enhanced corrosion resistance. 0.001% or more of P is contained to obtain such effects. Meanwhile, when P is contained in a large amount exceeding 0.020%, P segregates to grain boundaries, for example, thereby decreasing ductility and/or toughness. Accordingly, the content of P is 0.001 to 0.020%. The content of P is preferably 0.001 to 0.016% and more preferably 0.003 to 0.015%.

S: 0.005% or Less

S exists in steel primarily as sulfide inclusions such as MnS, and adversely affects ductility and/or toughness. Accordingly, S preferably decreases as much as possible. S up to 0.005% is allowed to be contained. Accordingly, the content of S is limited to 0.005% or less. Since an extreme decrease of S results in surging refining costs, the content of S is preferably 0.0001% or more and more preferably 0.0003% or more.

Al: 0.001 to 0.1%

Al is an element that acts as a strong deoxidizer. The content of Al needs to be 0.001% or more to provide such an effect. Meanwhile, when the content of Al exceeds 0.1%, oxide inclusions increase while cleanliness decreases, and thus ductility and/or toughness decrease(s). Accordingly, the content of Al is 0.001 to 0.1%. The content of Al is preferably 0.010 to 0.1%, more preferably 0.015 to 0.08%, and further preferably 0.020 to 0.07%.

Cr: 0.4 to 1.0%

Cr is an element that contributes to increased strength of a steel sheet, enhances corrosion resistance, and further acts to promote microstructure phase separation. The content of Cr needs to be 0.4% or more to obtain such effects. Meanwhile, when the content of Cr exceeds 1.0%, weldability in electric resistance welding decreases. Accordingly, the content of Cr is 0.4 to 1.0%. The content of Cr is preferably 0.4 to 0.9% and more preferably 0.5 to 0.9%.

Cu: 0.1 to 0.5%

Cu is an element that contributes to increased strength of a steel sheet and acts to enhance corrosion resistance. The content of Cu needs to be 0.1% or more to provide such effects. Meanwhile, when the content of Cu exceeds 0.5%, hot workability decreases. Accordingly, the content of Cu is 0.1 to 0.5%. The content of Cu is preferably 0.2 to 0.5% and more preferably 0.2 to 0.4%.

Ni: 0.01 to 0.4%

Ni is an element that contributes to increased strength and enhanced toughness of a steel sheet. The content of Ni needs to be 0.01% or more. Meanwhile, the content of Ni exceeding 0.4% results in surging material costs. Accordingly, the content of Ni is 0.01 to 0.4%. The content of Ni is preferably 0.05 to 0.3% and more preferably 0.10 to 0.3%.

Nb: 0.01 to 0.07%

Nb is an element that contributes to increased strength of a steel sheet through precipitation strengthening. Also, Nb is an element that contributes to an expanded non-recrystallization temperature region of austenite and facilitates rolling in the non-recrystallization temperature region, thereby contributing to increased strength and/or enhanced toughness of a steel sheet through refinement of a steel sheet microstructure. The content of Nb needs to be 0.01% or more to obtain such effects. Meanwhile, the content of Nb exceeding 0.07% results in decreased ductility and decreased toughness of a weld. Accordingly, the content of Nb is 0.01 to 0.07%. The content of Nb is preferably 0.01 to 0.06% and more preferably 0.01 to 0.05%.

N: 0.008% or Less

N is present in steel as an impurity and preferably decreases as much as possible since N decreases, in particular, toughness of a weld and causes slab cracking during casting. N up to 0.008% is allowed to be contained. Accordingly, the content of N is 0.008% or less. The content of N is preferably 0.006% or less.

Mo: 0.5% or Less and/or V: 0.1% or Less

Both Mo and V are elements that contribute to increased strength of a steel sheet. One of Mo and V is contained, or both Mo and V are contained.

Mo is an element that contributes to increased strength of a steel sheet by realizing, through enhanced hardenability, a microstructure primarily containing a bainite phase and a predetermined amount of a martensite phase and a retained austenite phase. Further, Mo acts to suppress softening when heat treatment such as annealing is performed after pipe making. Mo, if contained, is preferably contained at 0.05% or more to obtain such effects. Meanwhile, when Mo is contained at more than 0.5%, a martensite phase or a retained austenite phase is formed in a large amount, thereby decreasing toughness. Accordingly, the content of Mo, if contained, is 0.5% or less. The content of Mo is preferably 0.05 to 0.4%.

V is an element that contributes to increased strength of a steel sheet through enhanced hardenability and precipitation strengthening. Similar to Mo, V also acts to suppress softening when heat treatment such as annealing is performed after pipe making. V, if contained, is preferably contained at 0.003% or more to obtain such effects. Meanwhile, when V is contained at more than 0.1%, toughness of a base material and a weld decreases. Accordingly, the content of V, if contained, is 0.1% or less. The content of V is preferably 0.01 to 0.08%.

The above-described components are contained within the above-described ranges so that Moeq, defined as equation (1), is 1.4 to 2.2, where equation (1) is:

$$Moeq=Mo+0.36Cr+0.77Mn+0.07Ni \quad (1)$$

where Mo, Cr, Mn, and Ni represent the contents of the respective elements (mass %), and an element, if not contained, is set to zero.

Moeq is a parameter that affects formation of a secondary phase in a steel sheet microstructure as shown in FIG. 1 and needs to be adjusted to 1.4 or larger to ensure a predetermined amount of a martensite phase. Meanwhile, an increase in Moeq exceeding 2.2 causes decreased toughness. Accordingly, Mo, Cr, Mn, and Ni are adjusted so that Moeq is 1.4 to 2.2.

Further, Mo and V are contained in the above-described ranges so that expression (2) is satisfied, where expression (2) is:

$$0.05 \leq Mo+V \leq 0.5 \quad (2)$$

where Mo and V are the contents of the respective elements (mass %), and an element, if not contained, is set to zero. When (Mo+V) becomes smaller than 0.05 without satisfying expression (2), the effect on suppression of softening during heat treatment diminishes. When (Mo+V) exceeds 0.5 without satisfying expression (2), toughness of a base material and a weld decreases. Accordingly, Mo and V are adjusted within the above-described ranges to satisfy expression (2). (Mo+V) is preferably 0.05 to 0.4.

Although the above-described components are base components, optional elements of one or two or more selected from Ti: 0.03% or less, Zr: 0.04% or less, Ta: 0.05% or less, and B: 0.0010% or less, and/or one or two selected from Ca: 0.005% or less and REM: 0.005% or less may be selected and contained as appropriate.

One or Two or More Selected from Ti: 0.03% or Less, Zr: 0.04% or Less, Ta: 0.05% or Less, and B: 0.0010% or Less All of Ti, Zr, Ta, and B are elements that contribute to increased strength of a steel sheet, and thus one or two or more of these elements may be selected and contained as appropriate. Ti, Zr, Ta, and B are elements that form fine nitrides to suppress coarsening of crystal grains and contribute to enhanced toughness through microstructure refinement and to increased strength of a steel sheet through precipitation strengthening. Moreover, B contributes to increased strength of a steel sheet through enhanced hardenability. It is preferable to contain Ti: 0.005% or more, Zr: 0.01% or more, Ta: 0.01% or more, and/or B: 0.0002% or more to obtain such effects. Meanwhile, incorporation exceeding Ti: 0.03%, Zr: 0.04%, Ta: 0.05%, and/or B: 0.0010% increases coarse precipitates, thereby causing decreased toughness and/or ductility. Moreover, incorporation exceeding B: 0.0010% considerably enhances hardenability, thereby decreasing toughness and/or ductility. Accordingly, when one or two or more selected from Ti, Zr, Ta, and B are contained, it is preferable to limit respective elements to Ti: 0.03% or less, Zr: 0.04% or less, Ta: 0.05% or less, and B: 0.0010% or less.

One or Two Selected from Ca: 0.005% or Less and REM: 0.005% or Less

Both Ca and REM are elements that act to control the shape of sulfide inclusions, and one or two of these elements may be selected and contained as appropriate. It is preferable to contain Ca: 0.0005% or more and/or REM: 0.0005% or more to obtain such an effect. Meanwhile, incorporation in large amounts exceeding Ca: 0.005% and/or REM: 0.005% increases the amount of inclusions and thus causes decreased ductility. Accordingly, when one or two selected from Ca and REM are contained, it is preferable to limit to Ca: 0.005% or less and/or REM: 0.005% or less.

The balance excluding the above-described components is Fe and incidental impurities.

Next, the reasons for limiting the microstructure of a hot-rolled steel sheet will be described.

Our hot-rolled steel sheet has the above-described composition and a microstructure containing, in volume fraction, 80% or more of a bainite phase as a primary phase, and 4 to 20% of a martensite phase and a retained austenite phase in total as a secondary phase, where the bainite phase has an average grain size of 1 to 10 μm.

Primary Phase: 80% or More of, in Volume Fraction, Bainite Phase

The term "primary phase" herein refers to a phase that accounts for 80% or more in volume fraction. By setting a bainite phase as a primary phase, a hot-rolled steel sheet having high strength and excellent ductility of an elongation El: 16% or higher can be realized. When a martensite phase is a primary phase, desired high strength can be ensured, but ductility is unsatisfactory. Further, when a bainite phase is contained at less than 80% in volume fraction, desired high strength cannot be ensured, or neither desired high strength nor high ductility can be achieved simultaneously. Accordingly, 80% or more of, in volume fraction, a bainite phase is the primary phase.

Secondary Phase: 4 to 20% of, in Volume Fraction, Martensite Phase and Retained Austenite Phase in Total Provided that the primary phase is a bainite phase, 4% or more of, in volume fraction, a martensite phase and a retained austenite phase in total are dispersed as a secondary phase. This can realize a hot-rolled steel sheet having both desired ductility and high strength of TS: 900 MPa or higher. When less than 4% of a martensite phase and a retained austenite phase in total are dispersed, desired high strength cannot be ensured. Meanwhile, when a volume fraction of a martensite phase and a retained austenite phase in total becomes large exceeding 20% in volume fraction, the desired excellent ductility cannot be ensured. Retained austenite phase may be 0% in some cases.

It is preferable to disperse a martensite phase in a larger amount than a retained austenite to reduce variations in strength and ductility. A retained austenite phase is an unstable phase and is thus readily affected by working and/or heat treatment. Accordingly, variations in strength and ductility increase as the amount of retained austenite phase increases. The volume fraction of retained austenite phase is preferably 8% or less, and more preferably 4% or less.

Average Grain Size of Bainite Phase: 1 to 10 μm

In a hot-rolled steel sheet, an average grain size of the bainite phase is 1 to 10 μm to ensure desired ductility. When the average grain size of the bainite phase is less than 1 μm, a welded heat affected zone softens due to coarsening of microstructure while generating an extreme difference in strength between the welded heat affected zone and a base material, thereby causing buckling. Meanwhile, when the bainite phase coarsens to have an average grain size exceeding 10 μm, yield strength decreases. Accordingly, the average grain size of the bainite phase is 1 to 10 μm. The average grain size of the bainite phase is obtained by imaging a microstructure exposed with Nital etch by using a scanning electron microscope, calculating equivalent circle diameters from a grain boundary image through image analysis, and arithmetically averaging the equivalent circle diameters.

By having the above-described composition, a hot-rolled steel sheet can ensure, in a stable manner, the above-described microstructure everywhere in-plane even if cooling conditions after hot rolling change slightly and, consequently, variations in in-plane material properties of the steel sheet decrease.

Next, a preferable method of manufacturing a hot-rolled steel sheet will be described.

We perform a heating step and a hot rolling step on steel having the above-described composition to yield a hot-rolled steel sheet.

A manufacturing method for steel needs not be limited particularly. Any of common manufacturing methods for steel is applicable. For example, a preferable manufacturing method for steel includes refining molten steel having the above-described composition by a common refining method in a converter, an electric furnace, or a vacuum melting furnace, for example, and then producing a casting (steel) such as a slab, by a common casting method such as continuous casting. No problem arises if a slab is produced by an ingot casting/slabbing method.

First, a heating step is performed by heating the obtained steel to a heating temperature: 1,150° C. to 1,270° C.

When the heating temperature is lower than 1,150° C., precipitates such as carbides that have precipitated during casting cannot be dissolved satisfactorily and, consequently, desired high strength and/or desired high ductility cannot be ensured. Meanwhile, at a high temperature exceeding 1,270° C., crystal grains coarsen and, consequently, toughness decreases. In addition, oxidation, for example, becomes severe and, consequently, the yield decreases considerably. Accordingly, the heating temperature of steel is 1,150° C. to 1,270° C.

The heated steel undergoes a hot rolling step to yield a hot-rolled steel sheet of predetermined dimensions.

The hot rolling step is a process including hot rolling at a finish rolling temperature in the temperature range of 810° C. to 930° C. and at a cumulative reduction ratio in the temperature range of 930° C. or lower of 20 to 65%, then cooling the hot-rolled steel sheet to a cooling stop temperature in the temperature range of 420° C. to 600° C. at an average cooling rate of 10° C./s to 70° C./s, and coiling the cooled steel sheet at a coiling temperature in the temperature range of 400° C. to 600° C. The above-mentioned temperatures are temperatures in the surface position of steel.

Finish Rolling Temperature in Hot Rolling: 810° C. to 930° C.

The hot rolling is rolling composed of rough rolling and finish rolling. Rolling conditions for rough rolling need not be limited particularly provided that steel can be formed into a sheet bar of predetermined dimensions.

When the finish rolling temperature in finish rolling is lower than 810° C., deformation resistance becomes excessively high and thus rolling efficiency decreases. Meanwhile, when the finish rolling temperature in finish rolling becomes high exceeding 930° C., a reduction in the non-recrystallization temperature region of austenite is insufficient and, consequently, desired refinement of microstructure cannot be achieved. Accordingly, the finish rolling temperature in hot rolling is 810° C. to 930° C. The finish rolling temperature is adjusted so that an in-plane temperature fluctuation in the hot-rolled steel sheet is 50° C. or less (difference between the in-plane highest and the in-plane lowest finish rolling temperatures being 50° C. or less) through correction of temperature variations in a sheet bar by using a sheet bar heater or a bar heater, for example. This can ensure uniformity of material properties in a steel sheet as a whole and thus decreases variations in material properties. The use of a coil box that coils a sheet bar once, stores it, and provides it for rolling again, and/or heating of the sheet bar in a heating furnace are allowed only before finish rolling. One measure to suppress the temperature drop in an edge portion of a steel sheet is to limit cooling water in the edge portion of the steel sheet.

Cumulative Reduction Ratio in Temperature Range of 930° C. or Lower During Hot Rolling: 20 to 65%

By performing rolling in the non-recrystallization temperature region of austenite at 930° C. or lower, dislocations are generated and, consequently, refinement of microstructure can be achieved. When the cumulative reduction ratio is 20% or less, however, desired refinement of microstructure cannot be achieved. Meanwhile, when the cumulative reduction ratio becomes large exceeding 65%, deformation resistance increases due to precipitated Nb carbides during rolling and such Nb carbides coarsen at the same time. Consequently, Nb carbides that finely precipitate during bainite transformation, which occurs near the cooling stop temperature, decrease, and thus the strength decreases. Accordingly, the cumulative reduction ratio in the temperature range of 930° C. or lower is 20 to 65%. The cumulative reduction ratio is more preferably 30 to 60%.

Average Cooling Rate after Finishing Hot Rolling: 10° C./s to 70° C./s

Cooling is started immediately after finishing hot rolling. When the average cooling rate is slower than 10° C./s, a desired microstructure composed of a bainite phase as a primary phase, and a martensite phase and a retained austenite phase as a secondary phase cannot be formed since coarse polygonal ferrite and pearlite start to precipitate. Meanwhile, when the average cooling rate exceeds 70° C./s, a desired microstructure containing a bainite phase as a primary phase cannot be ensured since formation of a martensite phase increases and, consequently, uniformity of an in-plane microstructure and thus uniformity of material properties cannot be ensured, thereby failing to decrease variations in material properties. Accordingly, the average cooling rate after finishing hot rolling is 10° C./s to 70° C./s. The average cooling rate after finishing hot rolling is more preferably 20° C./s to 70° C./s. The average cooling rate is a value obtained by calculating an average cooling rate from the finish rolling temperature to the cooling stop temperature on the basis of the temperature in a surface position of steel.

Cooling Stop Temperature: 420° C. to 600° C.

When the cooling stop temperature is lower than 420° C., formation of martensite becomes significant and thus a desired microstructure containing a bainite phase as a primary phase cannot be realized. Meanwhile, when the cooling stop temperature is high exceeding 600° C., coarse polygonal ferrite is formed and, consequently, the desired high strength cannot be achieved. Accordingly, the cooling stop temperature is limited to the temperature range of 420° C. to 600° C. Preferably, the cooling stop temperature is 420° C. to 580° C.

After cooling is stopped, coiling is performed at a coiling temperature in the temperature range of 400° C. to 600° C. The above-described cooling conditions enable a coiling temperature to have an in-plane temperature fluctuation in a hot-rolled steel sheet of 80° C. or less (difference between the in-plane highest and the in-plane lowest temperatures in coiling of a hot-rolled steel sheet being 80° C. or less). Consequently, uniformity of material properties is readily ensured and thus variations in material properties can be suppressed.

Hot-rolled steel sheets manufactured by the above-described manufacturing method are preferably cold-formed into nearly cylindrical shapes, then electric resistance-welded to yield electric resistance welded steel pipes, or additionally, joined at the end portions of the respective electric resistance welded pipes, and coiled as long electric resistance welded steel pipes to yield coil tubing. No problem arises for applications, other than coil tubing such as for automobiles, for piping, and for mechanical structures.

We found that high strength of tensile strength TS: 900 MPa or higher and excellent ductility of elongation El: 16% or higher can be ensured by setting C: 0.10% or more and allowing a microstructure after hot rolling to contain a bainite phase as a primary phase, and 4% or more of, in volume fraction, a dispersed martensite phase and a retained austenite phase in total as a secondary phase. Further, we found that a steel sheet having small variations in material properties in the in-plane (coil) longitudinal direction and transverse direction (entire coil) is obtained by achieving such a microstructure composition and a microstructure fraction. Moreover, we found that to obtain a microstructure containing, in volume fraction, 4% or more of a martensite phase and a retained austenite phase in total, the microstructure needs to be a composition which satisfies Moeq of 1.4 to 2.2, where Moeq is defined by the following equation:

$$Moeq=Mo+0.36Cr+0.77Mn+0.07Ni \quad (1)$$

where Mo, Cr, Mn, and Ni are the contents of the respective elements in mass %.

First, the experimental results will be described.

Hot-rolled steel sheets having a sheet thickness of 3 to 6 mm were obtained by heating steel having a composition comprising, in mass %, C: 0.07 to 0.20%, Si: 0.27 to 0.48%, Mn: 1.44 to 1.98%, Al: 0.025 to 0.040%, Cr: 0.28 to 1.01%, Ni: 0.02 to 0.25%, Mo: 0 to 0.48%, Nb: 0.02 to 0.05%, V: 0 to 0.07%, and a balance of Fe to a heating temperature of 1,170° C. to 1,250° C., then hot-rolling at a cumulative reduction ratio in the non-recrystallization temperature region of 33 to 60% and at a finish rolling temperature of 820° C. to 890° C., cooling to a cooling stop temperature of 430° C. to 630° C. at an average cooling rate of 38° C./s to 68° C./s after finishing the hot-rolling, and coiling at a coiling temperature of 410° C. to 610° C.

Test pieces for microstructure observation and tensile test pieces, in which the tensile direction is orthogonal to the rolling direction, prescribed in ASTM A370 (gauge length: 50 mm) were taken from the obtained hot-rolled steel sheets. For the test pieces, the microstructure was observed, and the tensile characteristics were investigated. The tensile test was performed as prescribed in ASTM A370.

Each test piece for microstructure observation was polished and etched with Nital etch such that the cross section in the rolling direction of the obtained hot-rolled steel sheet became an observation surface, and the microstructure was observed and imaged using a scanning electron microscope (magnification: 2000×). A microstructure was identified and a microstructure fraction was determined for the obtained microstructure image by image analysis. The microstructure fraction of a retained austenite phase was determined by X-ray diffractometry. All the hot-rolled steel sheets shared the feature of having a microstructure containing a bainite phase as a primary phase, and a martensite phase and a retained austenite phase as a secondary phase.

The obtained results are shown in FIG. 1 as the relationship between Moeq and the total amount (volume fraction) of a martensite phase and a retained austenite phase. FIG. 1 shows that Moeq has a good correlation with a microstructure fraction of the secondary phase and thus reveals that Moeq needs to be 1.4 or higher to achieve the total amount of a martensite phase and a retained austenite phase of 4% or more.

Figure 2:
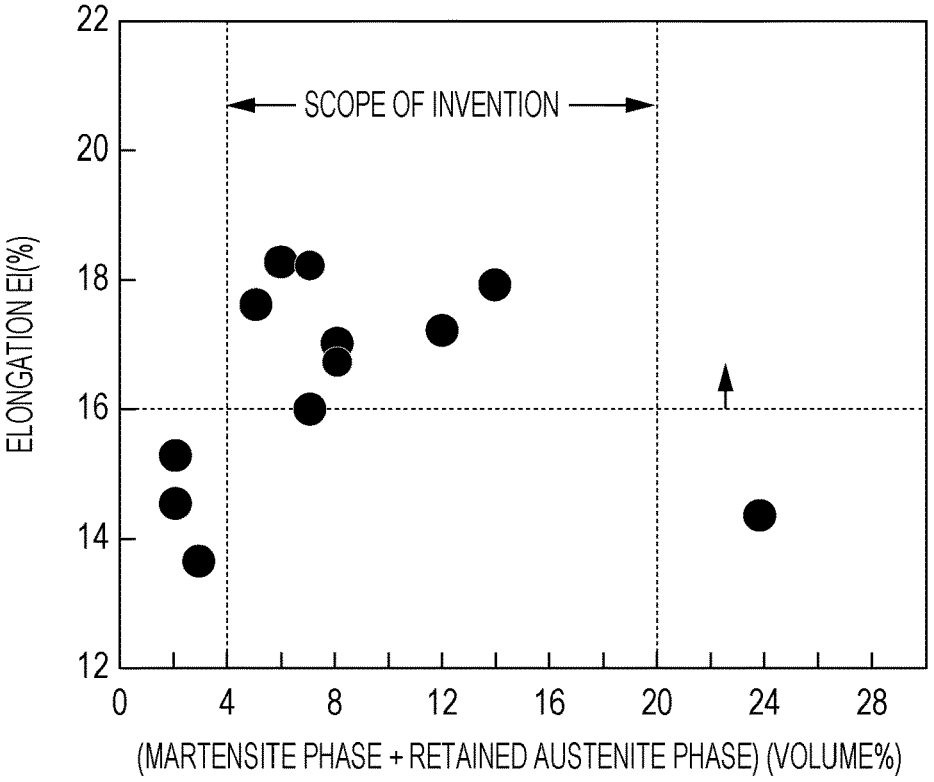
FIG. 2 is a graph showing the relationship between elongation and microstructure fraction of the secondary phase.

FIG. 2 shows the relationship between elongation El and the total amount of a martensite phase and a retained austenite phase. FIG. 2 reveals that an El of 16% or higher can be ensured by setting the total amount of a martensite phase and a retained austenite phase to 4% or more.

Hereinafter, our steel sheets and methods will be described further on the basis of Examples.

EXAMPLES

Molten steel having the composition shown in Table 1 was refined in a converter and formed into a casting (slab: thickness of 250 mm) by continuous casting to yield steel. The obtained steel was heated to the heating temperature shown in Table 2, then rough-rolled, and finish-rolled under conditions shown in Table 2 to yield hot-rolled steel sheets having the thickness shown in Table 2. After the end of hot rolling (finish rolling), cooling was started immediately at the average cooling rate shown in Table 2 to the cooling stop temperature shown in Table 2, followed by coiling at the coiling temperature shown in Table 2. In some cases, heating of sheet bars after rough rolling was performed by using an edge heater. In-plane temperature after the end of finish rolling was measured over the full length by using a radiation thermometer set in the line, and differences between the highest temperature and the lowest temperature, i.e., variations in finish rolling temperature, were investigated and shown in Table 2. Variations in coiling temperature were also measured similarly.

Test pieces were taken from two positions in total: at a position 20 m from the front edge in the rolling direction of the obtained hot-rolled steel sheet and at a position ⅛ width from the coil edge ⅛W (measuring position 1); and at a position 20 m from the tail edge in the rolling direction and at the central position in the coil width direction ½W (measuring position 2). The test pieces underwent microstructure observation, a tensile test, and an impact test. The test methods are as follows.

(1) Microstructure Observation

A specimen for microstructure observation was taken from the obtained test piece, polished so that the cross section (C-cross section) perpendicular to the rolling direction becomes an observation surface, and etched with Nital etch or LePera etchant to expose the microstructure. The microstructure was observed and imaged by using an optical microscope (magnification: 1000×) or a scanning electron microscope (magnification: 2000×). For the obtained microstructure image, the microstructure was identified and a microstructure fraction was determined by image analysis. An average grain size of the bainite phase was obtained by imaging the microstructure exposed by Nital etch by using a scanning electron microscope, calculating equivalent circle diameters for a grain boundary image through image analysis, and arithmetically averaging the equivalent circle diameters. Meanwhile, the microstructure fraction of retained austenite was obtained using another specimen by X-ray diffractometry.

(2) Tensile Test

A tensile test piece (gauge length: 50 mm) was taken from the obtained test piece such that the tensile direction became a direction orthogonal to the rolling direction, and a tensile test was performed as prescribed in ASTM A370 to measure tensile characteristics (yield strength YS, tensile strength TS, elongation El). Further, variations in in-plane yield strength YS were evaluated from differences (ΔYS) between YS in the above-mentioned measuring position 1 and YS in the above-mentioned measuring position 2.

(3) Impact Test

A V-notch specimen was taken from the obtained test piece such that the length direction became a direction orthogonal to the rolling direction, and a Charpy impact test was performed as prescribed in ASTM A370 to obtain absorbed energy, $vE_{-20}$ (J), at a test temperature of −20° C. Three specimens were tested, and an arithmetic average for absorbed energy, $vE_{-20}$ (J), of the three specimens was calculated. The value is regarded as an absorbed energy $vE_{-20}$ of the corresponding steel sheet.

The obtained results are shown in Table 3.

TABLE 1

| Steel No. | Chemical component (mass %) C | Si | Mn | P | S | Al | Cr | Cu | Ni | Nb | N | Mo, V | Ti, Zr, Ta, B | Ca, REM | Moeq* | Equation (1)* | Expression (2)** | Note |
|---|---|---|---|---|---|---|---|---|---|---|---|---|---|---|---|---|---|---|
| A | 0.16 | 0.35 | 1.66 | 0.014 | 0.002 | 0.031 | 0.57 | 0.30 | 0.15 | 0.04 | 0.003 | V: 0.05 | — | — | 1.49 | Satisfied | Satisfied | Example |
| B | 0.12 | 0.44 | 1.98 | 0.009 | 0.002 | 0.025 | 0.81 | 0.26 | 0.14 | 0.03 | 0.003 | Mo: 0.28 | Ti: 0.02 | — | 2.11 | Satisfied | Satisfied | Example |
| C | 0.18 | 0.47 | 1.90 | 0.012 | 0.001 | 0.030 | 0.65 | 0.24 | 0.19 | 0.04 | 0.002 | Mo: 0.26 | Ti: 0.02 | Ca: 0.002 | 1.97 | Satisfied | Satisfied | Example |
| D | 0.11 | 0.39 | 1.71 | 0.011 | 0.002 | 0.034 | 0.61 | 0.26 | 0.19 | 0.04 | 0.003 | Mo: 0.25 | Ti: 0.01 | — | 1.80 | Satisfied | Satisfied | Example |
| E | 0.10 | 0.48 | 1.44 | 0.014 | 0.003 | 0.026 | 0.80 | 0.27 | 0.17 | 0.02 | 0.002 | Mo: 0.18, V: 0.07 | Ti: 0.01 | — | 1.59 | Satisfied | Satisfied | Example |
| F | 0.15 | 0.40 | 1.75 | 0.010 | 0.002 | 0.033 | 0.78 | 0.23 | 0.16 | 0.02 | 0.002 | Mo: 0.37 | Zr: 0.03 | REM: 0.004 | 2.01 | Satisfied | Satisfied | Example |
| G | 0.10 | 0.45 | 1.88 | 0.010 | 0.003 | 0.030 | 0.80 | 0.25 | 0.20 | 0.05 | 0.004 | Mo: 0.02, V: 0.07 | Ti: 0.01, B: 0.0007 | — | 1.77 | Satisfied | Satisfied | Example |
| H | 0.07 | 0.33 | 1.70 | 0.010 | 0.002 | 0.027 | 0.54 | 0.25 | 0.23 | 0.04 | 0.003 | Mo: 0.20 | Ti: 0.01 | Ca: 0.002 | 1.72 | Satisfied | Satisfied | Comparative Example |
| I | 0.10 | 0.34 | 1.86 | 0.010 | 0.001 | 0.031 | 1.01 | 0.26 | 0.25 | 0.04 | 0.002 | Mo: 0.48, V: 0.07 | Ti: 0.01 | — | 2.29 | Unsatisfied | Unsatisfied | Comparative Example |
| J | 0.11 | 0.27 | 1.95 | 0.012 | 0.001 | 0.040 | 0.28 | 0.02 | 0.02 | 0.03 | 0.002 | Mo: 0.21, V: 0.06 | Ti: 0.01 | — | 1.81 | Satisfied | Satisfied | Comparative Example |
| K | 0.20 | 0.40 | 1.69 | 0.013 | 0.002 | 0.029 | 0.54 | 0.31 | 0.18 | 0.04 | 0.003 | Mo: 0.16 | Ti: 0.01 | — | 1.67 | Satisfied | Satisfied | Comparative Example |

*Moeq = Mo + 0.36Cr + 0.77Mn + 0.07Ni (1)

**0.05 ≤ Mo + V ≤ 0.5 (2)

Underline: Outside scope of this disclosure

TABLE 2

| Steel sheet No. | Steel No. | Hot rolling: Heating Heating temperature (° C.) | Cumulative reduction ratio in non-recrystallization temperature region* (%) | Finish rolling temperature (° C.) | In-plane fluctuation in finish rolling temperature (° C.) | Sheet thickness (mm) | Cooling: Average cooling rate (° C./s) | Cooling stop temperature (° C.) | Coiling temperature (° C.) | In-plane fluctuation in coiling temperature (° C.) | Note |
|---|---|---|---|---|---|---|---|---|---|---|---|
| 1 | A | 1200 | 36 | 880 | 25 | 5 | 38 | 600 | 580 | 35 | Example |
| 2 | A | 1200 | 36 | 870 | 16 | 5 | 45 | 570 | 530 | 41 | Example |
| 3 | A | 1200 | 55 | 830 | 24 | 5 | 38 | 630 | 610 | 30 | Comparative Example |
| 4 | B | 1170 | 36 | 870 | 12 | 5 | 42 | 570 | 530 | 25 | Example |
| 5 | C | 1250 | 53 | 840 | 18 | 3 | 67 | 550 | 510 | 34 | Example |
| 6 | C | 1250 | 53 | 840 | 15 | 3 | 64 | 430 | 410 | 35 | Example |
| 7 | C | 1250 | 53 | 830 | 22 | 3 | 315 | 500 | 480 | 40 | Comparative Example |
| 8 | D | 1170 | 36 | 890 | 20 | 5 | 38 | 570 | 550 | 36 | Example |
| 9 | E | 1170 | 36 | 880 | 16 | 5 | 42 | 550 | 530 | 37 | Example |
| 10 | E | 1170 | 36 | 880 | 54 | 5 | 49 | 530 | 510 | 85 | Comparative Example |
| 11 | F | 1170 | 36 | 870 | 28 | 5 | 53 | 590 | 570 | 42 | Example |
| 12 | G | 1200 | 55 | 850 | 26 | 3 | 68 | 530 | 500 | 39 | Example |
| 13 | H | 1170 | 36 | 890 | 20 | 5 | 38 | 500 | 480 | 35 | Comparative Example |
| 14 | I | 1170 | 53 | 830 | 26 | 3 | 64 | 590 | 550 | 41 | Comparative Example |
| 15 | J | 1170 | 36 | 880 | 24 | 5 | 40 | 480 | 460 | 40 | Comparative Example |

TABLE 2-continued

| Steel sheet No. | Steel No. | Hot rolling: Heating Heating temperature (° C.) | Hot rolling: Cumulative reduction ratio in non-recrystallization temperature region* (%) | Hot rolling: Finish rolling temperature (° C.) | Hot rolling: In-plane fluctuation in finish rolling temperature (° C.) | Sheet thickness (mm) | Cooling: Average cooling rate (° C./s) | Cooling: Cooling stop temperature (° C.) | Cooling: Coiling temperature (° C.) | Cooling: In-plane fluctuation in coiling temperature (° C.) | Note |
|---|---|---|---|---|---|---|---|---|---|---|---|
| 16 | K | 1200 | 53 | 850 | 19 | 6 | 39 | 550 | 540 | 62 | Comparative Example |

*Temperature range of 930° C. or lower

Underline: Outside scope of this disclosure

TABLE 3

| Steel sheet No. | Steel No. | Test results, Measuring position 1 (1/8W): Microstructure Type* | B phase (volume %) | M + γ (volume %) | Other (volume %) | Grain size** (μm) | Tensile characteristics YS (MPa) | TS (MPa) | El (%) | Toughness $vE_{-20}$ (J) | Measuring position 2 (1/2W) Microstructure Type* |
|---|---|---|---|---|---|---|---|---|---|---|---|
| 1 | A | B + M + P | 94 | 5 | P: 1 | 2.5 | 667 | 1042 | 17.8 | 35 | B + P + M + γ |
| 2 | A | B + M + P | 93 | 5 | P: 2 | 2.2 | 678 | 1090 | 16.6 | 31 | B + M + γ |
| 3 | A | F + P + B + M | 45 | 2 | F + P: 53 | 3.3 | 639 | 842 | 18.4 | 15 | F + P + B + M |
| 4 | B | B + M | 92 | 8 | 0 | 2.1 | 656 | 1040 | 16.8 | 54 | B + M + γ |
| 5 | C | B + M + γ | 90 | 10 | 0 | 2.5 | 694 | 1084 | 16.8 | 33 | B + M + γ |
| 6 | C | B + M + γ | 91 | 9 | 0 | 1.9 | 654 | 1038 | 18.0 | 42 | B + M |
| 7 | C | B + M | 56 | 44 | 0 | 3.0 | 885 | 992 | 9.2 | 6 | B + M |
| 8 | D | B + M + γ | 95 | 5 | 0 | 2.2 | 672 | 1013 | 17.0 | 51 | B + P + M + γ |
| 9 | E | B + M + γ | 95 | 5 | 0 | 2.5 | 656 | 1040 | 17.2 | 37 | B + M + γ |
| 10 | E | B + F | 86 | 0 | F: 14 | 1.8 | 556 | 885 | 17.4 | 22 | B + M + γ |
| 11 | F | B + M + γ | 94 | 6 | 0 | 2.3 | 643 | 1021 | 17.7 | 69 | B + M + γ |
| 12 | G | B + M + γ | 95 | 5 | 0 | 2.3 | 607 | 964 | 17.4 | 47 | B + M + γ |
| 13 | H | B + M | 99 | 1 | 0 | 2.5 | 661 | 1010 | 14.9 | 35 | B + M |
| 14 | I | B + F + M | 87 | 5 | F: 8 | 2.9 | 652 | 1035 | 18.0 | 15 | B + M + γ |
| 15 | J | B + P + M + γ | 96 | 2 | P: 2 | 2.1 | 635 | 914 | 14.4 | 39 | B + M |
| 16 | K | B + P + M + γ | 85 | 4 | P: 11 | 2.8 | 699 | 1061 | 12.3 | 14 | B + P + M + γ |

| Steel sheet No. | Test results, Measuring position 2 (1/2W): Microstructure B phase (volume %) | M + γ (volume %) | Other (volume %) | Grain size** (μm) | Tensile characteristics YS (MPa) | TS (MPa) | El (%) | Toughness $vE_{-20}$ (J) | ΔYS*** (MPa) | Note |
|---|---|---|---|---|---|---|---|---|---|---|
| 1 | 93 | 6 | P: 1 | 2.8 | 646 | 1060 | 18.4 | 32 | 21 | Example |
| 2 | 92 | 8 | 0 | 2.3 | 664 | 1106 | 17.1 | 31 | 14 | Example |
| 3 | 37 | 2 | F + P: 61 | 4.1 | 622 | 886 | 19.1 | 11 | 17 | Comparative Example |
| 4 | 92 | 8 | 0 | 2.3 | 638 | 1046 | 17.1 | 48 | 18 | Example |
| 5 | 86 | 14 | 0 | 2.5 | 668 | 1096 | 18.0 | 36 | 26 | Example |
| 6 | 88 | 12 | 0 | 2.2 | 645 | 1058 | 17.3 | 40 | 9 | Example |
| 7 | 74 | 26 | 0 | 2.0 | 843 | 1190 | 11.2 | 9 | 42 | Comparative Example |
| 8 | 93 | 5 | P: 2 | 2.4 | 648 | 1045 | 17.7 | 41 | 24 | Example |
| 9 | 92 | 8 | 0 | 2.8 | 648 | 1064 | 16.8 | 30 | 8 | Example |
| 10 | 58 | 42 | 0 | 2.6 | 632 | 1053 | 18.1 | 7 | 76 | Comparative Example |
| 11 | 93 | 7 | 0 | 2.4 | 639 | 1048 | 18.3 | 45 | 4 | Example |
| 12 | 93 | 7 | 0 | 2.5 | 608 | 980 | 16.0 | 42 | 1 | Example |
| 13 | 98 | 2 | 0 | 2.6 | 763 | 1072 | 15.4 | 28 | 102 | Comparative Example |
| 14 | 76 | 24 | 0 | 2.8 | 734 | 1207 | 14.4 | 11 | 82 | Comparative Example |
| 15 | 97 | 3 | 0 | 2.2 | 637 | 1045 | 13.7 | 34 | 2 | Comparative Example |

TABLE 3-continued

| | | | | | | | | | | |
|---|---|---|---|---|---|---|---|---|---|---|
| 16 | 86 | 2 | P: 12 | 3.0 | 789 | 1162 | 14.6 | 15 | 90 | Comparative Example |

*B: bainite phase, M: martensite phase, γ: retained austenite, F: ferrite phase, P: pearlite
**Average grain size of bainite phase
***Difference between measuring position 1 and measuring position 2
Underline: Outside scope of this disclosure All Examples were hot-rolled steel sheets having: a desired microstructure containing, in volume fraction, 80% or more of a bainite phase as a primary phase, and 4% or more of a martensite phase and a retained austenite phase in total, where the microstructure is a fine microstructure as the bainite phase has an average grain size of 10 μm or smaller; a high tensile strength TS: 900 MPa or higher; high ductility of an elongation El: 16% or higher; decreased variations in in-plane yield strength, YS (ΔYS: 70 MPa or less); and excellent uniformity of material properties and thus decreased variations in material properties. Further, our Examples were hot-rolled steel sheets having a yield strength YS of 550 to 850 MPa, a high toughness $vE_{-20}$ of 20 J or higher, and decreased variations in in-plane strength TS, elongation El, and toughness $vE_{-20}$. In contrast, Comparative Examples, which are outside our scope, were unable to simultaneously have desired high strength, desired high ductility, and desired uniformity of material properties since a desired microstructure could not be obtained, the tensile strength TS was lower than 900 MPa, the elongation El was lower than 16%, or variations in in-plane yield strength, YS, were large (ΔYS: more than 70 MPa).

The invention claimed is:

1. A high-strength hot-rolled steel sheet for an electric resistance welded steel pipe, having a composition containing, in mass %, C: 0.11 to 0.18%,
Si: 0.1 to 0.5%,
Mn: 0.8 to 2.0%,
P: 0.001 to 0.020%,
S: 0.005% or less,
Al: 0.001 to 0.1%,
Cr: 0.4 to 1.0%,
Cu: 0.1 to 0.5%,
Ni: 0.01 to 0.4%,
Nb: 0.01 to 0.07%,
N: 0.008% or less, and further
Mo: 0.5% or less and/or V: 0.1% or less so that Moeq defined by equation (1) is 1.4 to 2.2 and Mo and V are contained to satisfy expression (2), and a balance of Fe and incidental impurities; and having a microstructure containing, in volume fraction, 80% or more of a bainite phase as a primary phase and 4 to 20% of a martensite phase and a retained austenite phase in total as a secondary phase, the bainite phase having an average grain size of 1 to 10 μm, wherein equation (1) and expression (2) are:

$$Moeq=Mo+0.36Cr+0.77Mn+0.07Ni \quad (1)$$

$$0.05 \leq Mo+V \leq 0.5 \quad (2)$$

where each element symbol in equation (1) and expression (2) represents the content of each element (mass %), and an element, if not contained, is set to zero, and wherein variations in in-plane yield strength YS is 70 MPa or less.

2. The high-strength hot-rolled steel sheet according to claim 1, wherein the composition further contains, in mass %, one or two or more selected from Ti: 0.03% or less,
Zr: 0.04% or less,
Ta: 0.05% or less, and
B: 0.0010% or less.

3. The high-strength hot-rolled steel sheet according to claim 1, wherein the composition further contains, in mass %, one or two selected from Ca: 0.005% or less and
REM: 0.005% or less.

4. A method of manufacturing a high-strength hot-rolled steel sheet for an electric resistance welded steel pipe, having a microstructure containing, in volume fraction, 80% or more of a bainite phase as a primary phase, and 4 to 20% of a martensite phase and a retained austenite phase in total as a secondary phase, the bainite phase having an average grain size of 1 to 10 μm, the method comprising a heating step, and a hot-rolling step of steel to yield a hot-rolled steel sheet, wherein:

the steel has a composition containing, in mass %,

C: 0.11 to 0.18%,
Si: 0.1 to 0.5%,
Mn: 0.8 to 2.0%,
P: 0.001 to 0.020%,
S: 0.005% or less,
Al: 0.001 to 0.1%,
Cr: 0.4 to 1.0%,
Cu: 0.1 to 0.5%,
Ni: 0.01 to 0.4%,
Nb: 0.01 to 0.07%,
N: 0.008% or less, and further
Mo: 0.5% or less and/or V: 0.1% or less so that Moeq defined by equation (1) is 1.4 to 2.2 and Mo and V are contained to satisfy expression (2), and a balance of Fe and incidental impurities;

wherein the heating step is a process of heating the steel to a heating temperature: 1,150° C. to 1,270° C.;

the hot-rolling step is a process including hot rolling at a finish rolling temperature in a temperature range of 810° C. to 930° C. and at a cumulative reduction ratio in a temperature range of 930° C. or lower of 20 to 65%, then cooling to a cooling stop temperature in a temperature range of 420° C. to 600° C. at an average cooling rate of 10° C./s to 70° C./s, and coiling in a temperature range of 400° C. to 600° C., where in the hot rolling step, an in-plane temperature fluctuation in the finish rolling temperature is 50° C. or less through correction of temperature variations by using a sheet bar heater or a bar heater, and an in-plane temperature fluctuation in the coiling temperature is 80° C. or less, and equation (1) and expression (2) are:

$$Moeq=Mo+0.36Cr+0.77Mn+0.07Ni \quad (1)$$

$$0.05 \leq Mo+V \leq 0.5 \quad (2)$$

where each element symbol in equation (1) and expression (2) represents the content of each element (mass %), and an element, if not contained, is set to zero, and wherein variations in in-plane yield strength YS is 70 MPa or less.

5. The method according to claim 4, wherein the composition further contains, in mass %, one or two or more selected from Ti: 0.03% or less, Zr: 0.04% or less, Ta: 0.05% or less, and B: 0.0010% or less.

6. The method according to claim 4, wherein the composition further contains, in mass %, one or two selected from Ca: 0.005% or less and REM: 0.005% or less.

7. The high-strength hot-rolled steel sheet according to claim 2, wherein the composition further contains, in mass %, one or two selected from Ca: 0.005% or less and REM: 0.005% or less.

8. The method according to claim 5, wherein the composition further contains, in mass %, one or two selected from Ca: 0.005% or less and REM: 0.005% or less.

9. The high-strength hot-rolled steel sheet according to claim 1, wherein the microstructure contains 4% or less of the retained austenite phase.

10. The method according to claim 4, wherein the microstructure contains 4% or less of the retained austenite phase.

* * * * *